US007260954B2

(12) United States Patent
Jang et al.

(10) Patent No.: US 7,260,954 B2
(45) Date of Patent: Aug. 28, 2007

(54) DRAINAGE STRUCTURE FOR REFRIGERATOR WITH INTEGRATED PRODUCT

(75) Inventors: Chan-Kyoo Jang, Changwon (KR); Soo-Beom Lee, Changwon (KR)

(73) Assignee: LG Electronics, Inc., Seoul (KR)

( * ) Notice: Subject to any disclaimer, the term of this patent is extended or adjusted under 35 U.S.C. 154(b) by 303 days.

(21) Appl. No.: 11/024,709

(22) Filed: Dec. 30, 2004

(65) Prior Publication Data

US 2005/0138949 A1 Jun. 30, 2005

(30) Foreign Application Priority Data

Dec. 31, 2003 (KR) ..... 10-2003-0101599
Feb. 2, 2004 (KR) ..... 10-2004-0006787
Feb. 2, 2004 (KR) ..... 10-2004-0006789

(51) Int. Cl.
*F25D 21/14* (2006.01)
*A47B 96/04* (2006.01)

(52) U.S. Cl. ..... 62/285; 62/289; 312/405

(58) Field of Classification Search ..... 62/331, 62/285, 259.2, 126, 440, 289; 312/401, 405, 312/405.1, 229, 321.5, 23; 248/917, 918
See application file for complete search history.

(56) References Cited

U.S. PATENT DOCUMENTS 1,850,514 A * 3/1932 Norwood ..... 49/71
5,487,276 A * 1/1996 Namisniak et al. ..... 62/125
6,131,812 A * 10/2000 Schneider ..... 235/385
6,502,411 B2 * 1/2003 Okamoto ..... 62/129
6,682,161 B2 * 1/2004 Yun ..... 312/405
6,739,144 B2 * 5/2004 Yun-Ho et al. ..... 62/125
6,927,871 B1 * 8/2005 Silverbrook et al. ..... 358/1.15

FOREIGN PATENT DOCUMENTS

DE 69220117 9/1997
DE 10054912 A1 * 8/2001
DE 10061747 10/2001
JP 10-173353 6/1998
JP 2001-280815 10/2001

* cited by examiner

*Primary Examiner*—Mohammad M. Ali
(74) *Attorney, Agent, or Firm*—Ked & Associates, LLP

(57) ABSTRACT

A drainage structure for a refrigerator equipped with an integrated product is provided. A mounting space is provided on a front surface of a door of the refrigerator to receive an integrated product such as a TV. A plurality of recesses are formed in an inner surface of the mounting space. The recesses prevent water drops from flowing downward along the inner surface. A plurality of valleys may also be formed on the inner surface on which the recesses are formed. The valleys may have an irregular shape, and serve to reduce the size of water drops. Thus, moisture formed in a space into which the integrated product is mounted can be evaporated and discharged to the outside due to heat generated by the integrated product when it is operated.

22 Claims, 5 Drawing Sheets

DRAINAGE STRUCTURE FOR REFRIGERATOR WITH INTEGRATED PRODUCT

BACKGROUND OF THE INVENTION

1. Field of Invention

The present invention relates to a refrigerator, and more particularly, to a drainage structure for a refrigerator with an additional product integrated therewith.

2. Description of the Prior Art

A refrigerator equipped with a variety of integrated products attached to a door thereof has been recently put on the market. Such additional products to be integrated with the refrigerator include a TV, an audio system, a computer, a monitor and the like, but a television is exemplified by way of example. A TV is a device for providing television broadcast by reproducing video and audio signals transmitted over the radio. FIG. 1 shows a general refrigerator equipped with a TV.

As shown in the figure, a freezing chamber door 11 and a refrigerating chamber door 13 are installed on a main body 10 of a refrigerator, respectively. The doors 11 and 13 serve to selectively open and close freezing and refrigerating chambers defined within the main body 10 of the refrigerator, respectively. A dispenser 15 for dispensing water out of the refrigerator is provided on the freezing chamber door 11, and a TV 17 corresponding to an additional product to be integrated with the refrigerator is installed on the refrigerating chamber door 13.

The TV 17 receives the video and audio signals transmitted over the radio and outputs an image and sound to the outside such that a TV viewer can watch a television broadcast. An opening 18*a* is formed on a front panel of the TV 17 such that a screen 19 is exposed to the outside. A plurality of through-holes 18*b* serving as speaker holes are perforated on the front panel 18.

However, the refrigerator with an additional product integrated therewith according to the prior art so configured has the following problems.

That is, the TV 17 generates a predetermined amount of heat when it is used. Thus, the temperature in the outside of the refrigerating chamber door 13 adjacent to the TV 17 is increased to a temperature relatively higher than a room temperature. Further, the temperature in the interior of a storage space for storing the food therein is lower than a room temperature. Therefore, the difference in temperature is produced between the inside and outside of the refrigerating chamber door 13 on which the TV 17 is installed.

Accordingly, moisture may be condensed on a front surface of the refrigerating chamber door 13 facing a rear surface of the TV 17. Then, the moisture is collected into a water drops with a predetermined size, which in turn flow downward due to their own weights. Further, the water drop may be introduced into the TV 17 or a portion from which a lead wire connected to the TV 17 is taken out, thereby causing the malfunction of the product.

In addition, the refrigerator is generally installed in a kitchen where water is frequently used. Thus, while a user do the housework or cleaning the refrigerator, water drops may be splashed on the front panel 18 and introduced into the TV 17 via a gap between the front panel 18 and the screen 19 or the through-holes 18*b*, thereby causing failure or malfunction of the TV 17.

SUMMARY OF THE INVENTION

Accordingly, the present invention is conceived to solve the aforementioned problem in the prior art. An object of the present invention is to provide a drainage structure for a refrigerator with an integrated product mounted to a door thereof, by which moisture produced between the integrated product and the door can be easily removed.

Another object of the present invention is to provide a drainage structure for a refrigerator with an integrated product mounted to a door thereof, by which moisture can be effectively prevented from permeating into the integrated product from the outside of the refrigerator.

According to the present invention for achieving the objects, there is provided a drainage structure for a refrigerator with an integrated product mounted to a refrigerator door thereof for opening and closing a storage space defined in a main body of the refrigerator, comprising: a mounting space provided at a portion on a front surface of the refrigerator door to mount the integrated product therein; and a plurality of recesses depressed into a part of an inner surface of the mounting space to extend in a direction perpendicular to the gravitational direction.

Each of the recesses has a predetermined width and depth, and is formed in a straight line such that the adjacent recesses are spaced apart from each other at a predetermined interval in the gravitational direction.

A plurality of valleys are formed on the inner surface of the mounting space in the form of irregular lines.

A floor surface of the mounting space is inclined downward toward the front of the refrigerator at a predetermined angle with respect to a horizontal surface.

A covering duct is further formed on the floor surface of the mounting space to cover a wire outlet through which a lead wire to be connected to the integrated product is taken out.

The covering duct is generally shaped as a hexahedron of which front face is open upwards or toward the front of the door.

A wire guide slit is further formed on both lateral walls of the covering duct to hold the lead wire.

A drainage channel along which water drops are guided is formed to circumscribe an edge of a front panel of the integrated product.

According to another aspect of the present invention, there is provided a drainage structure for a refrigerator in which a storage space defined in a main body of the refrigerator is opened and closed by a refrigerator door, comprising: a receiving box formed with a mounting space therein, said mounting space being provided at a portion on a front surface of the door and open toward the front of the door; and an integrated product securely seated in the mounting space of the receiving box and including a front panel defining an edge on a front surface of the integrated product, wherein a plurality of recesses are depressed into a part of an inner surface of the mounting space to extend in a direction perpendicular to the gravitational direction, and a floor surface is formed on a lower end of the mounting space to be inclined downward toward the front of the mounting space.

A mounting bracket is provided at the rear of the integrated product to be fastened to an edge of the receiving box, and a covering frame is mounted to the edge on the front surface of the integrated product to cover the edge of the front panel of the integrated product and the edge of the receiving box therewith.

Each of the recesses has a predetermined width and depth, and is formed in a straight line such that the adjacent recesses are spaced apart from each other at a predetermined interval in the gravitational direction.

A plurality of valleys are formed on the inner surface of the mounting space in the form of irregular lines.

A covering duct is further formed on the floor surface of the mounting space to cover a wire outlet through which a lead wire to be connected to the integrated product is taken out.

The covering duct is generally shaped as a hexahedron of which front face is open upwards or toward the front of the door.

A wire guide slit is further formed on both lateral walls of the covering duct to hold the lead wire.

A drainage channel along which water drops are guided is formed to circumscribe the edge of the front panel of the integrated product.

According to another aspect of the present invention, there is provided a drainage structure for a refrigerator in which a storage space defined in a main body of the refrigerator is opened and closed by a refrigerator door, comprising: a receiving box formed with a mounting space therein, said mounting space being provided at a portion on a front surface of the door and open toward the front of the door; and an integrated product securely seated in the mounting space of the receiving box and including a front panel defining an edge on a front surface of the integrated product, wherein a plurality of recesses are depressed into a part of an inner surface of the mounting space to extend in a direction perpendicular to the gravitational direction, and a plurality of valleys are formed on the inner surface of the mounting space in the form of irregular lines.

A floor surface is formed on a lower end of the mounting space to be inclined downward toward the front of the mounting space, and a covering duct is further formed on the floor surface of the mounting space to cover a wire outlet through which a lead wire to be connected to the integrated product is taken out.

The covering duct is generally shaped as a hexahedron of which front face is open upwards or toward the front of the door, and a wire guide slit is further formed on both lateral walls of the covering duct to hold the lead wire.

A mounting bracket is provided at the rear of the integrated product to be fastened to an edge of the receiving box, and a covering frame is mounted to the edge on the front surface of the integrated product to cover the edge of the front panel of the integrated product and the edge of the receiving box therewith.

Each of the recesses has a predetermined width and depth, and is formed in a straight line such that the adjacent recesses are spaced apart from each other at a predetermined interval in the gravitational direction.

A drainage channel along which water drops are guided is formed to circumscribe the edge of the front panel of the integrated product.

With the drainage structure for a refrigerator equipped with an integrated product according to the present invention, the moisture produced between the integrated product and the door and the water splashed from the outside of the refrigerator can be effectively prevented from permeating into the integrated product.

BRIEF DESCRIPTION OF THE DRAWINGS

The above and other objectives, features and advantages of the present invention will become apparent from the following description of a preferred embodiment given in conjunction with the accompanying drawings, in which.

DETAILED DESCRIPTION OF THE PREFERRED EMBODIMENT

Hereinafter, preferred embodiments of a drainage structure for a refrigerator equipped with an integrated product according to the present invention will be described in detail with reference to the accompanying drawings.

Figure 1:
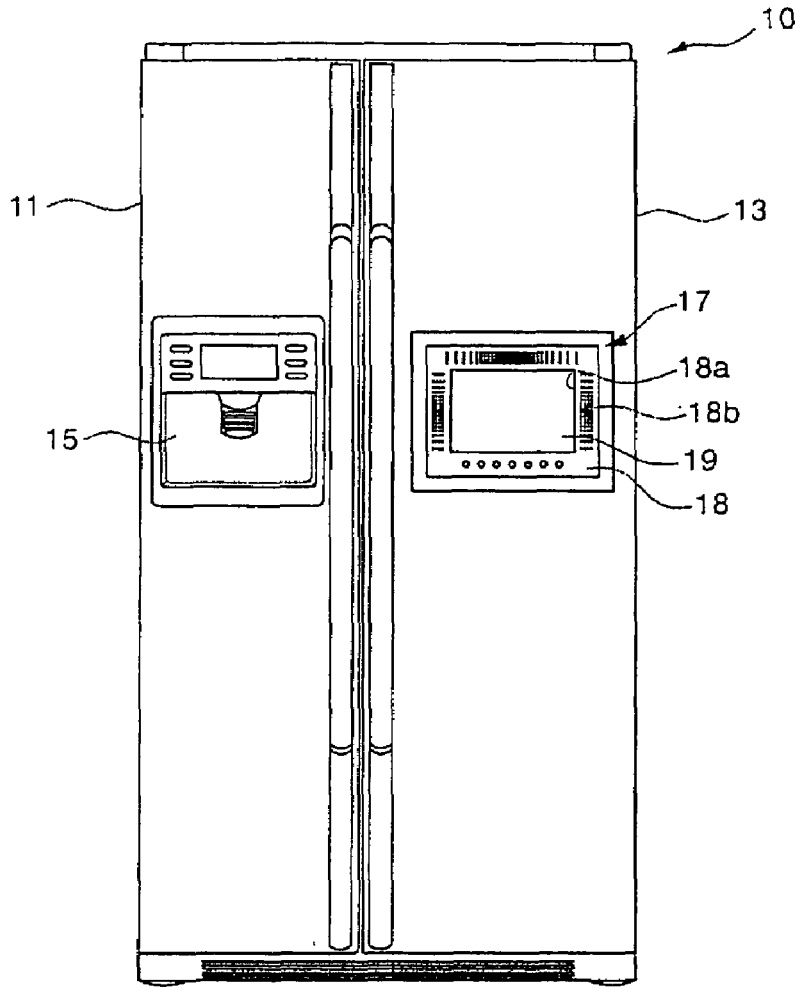
FIG. 1 Related Art
FIG. 1 is a front view showing the configuration of a general refrigerator with an additional product integrated therewith.
Figure 2:
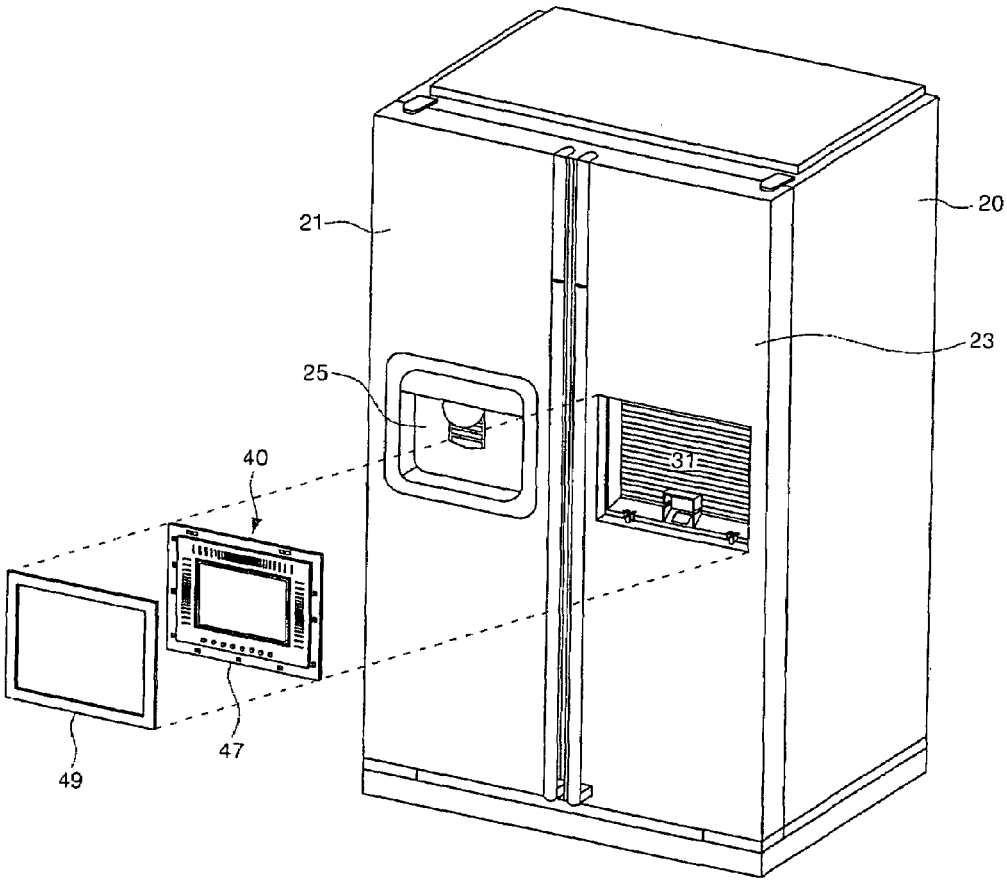
FIG. 2 is an exploded perspective view of a refrigerator with a drainage structure formed therein according to a preferred embodiment of the present invention.
Figure 3:
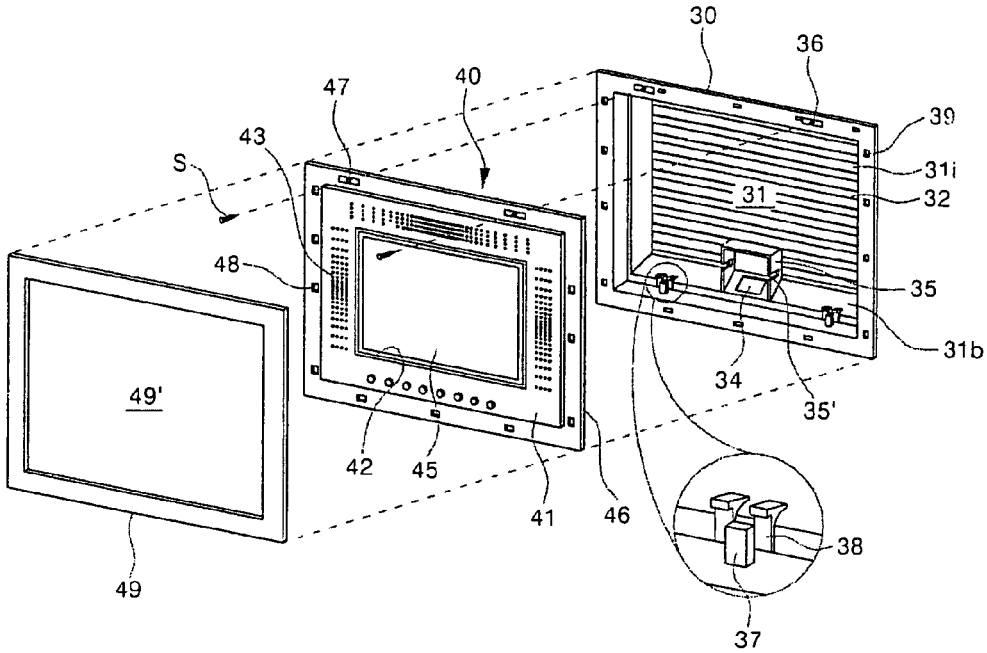
FIG. 3 is an exploded perspective view of main components of the drainage structure according to the embodiment shown in FIG. 2.
Figure 4:
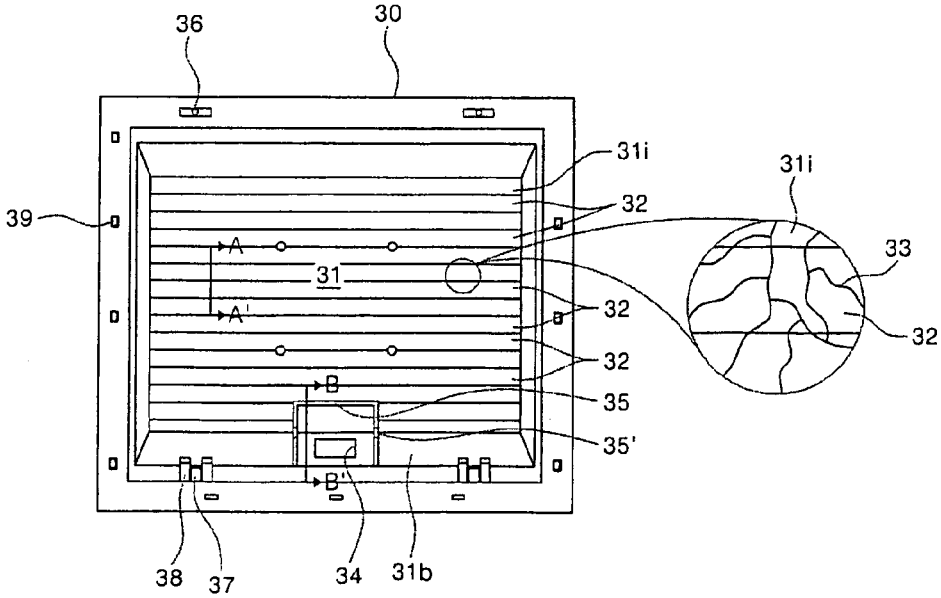
FIG. 4 is a front view of a receiving box according to the embodiment shown in FIG. 2.
Figure 5:
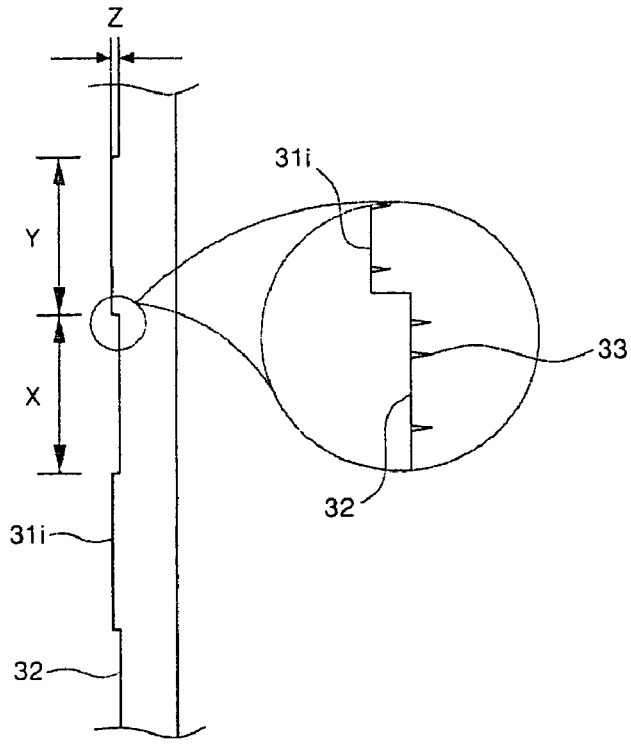
FIG. 5 is a sectional view taken along line A-A' of FIG. 4.
Figure 6:
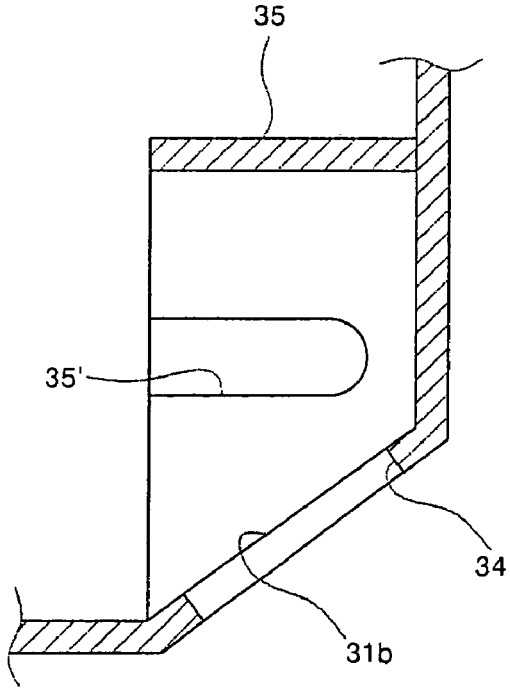
FIG. 6 is a sectional view taken along line B-B' of FIG. 4.

FIG. 2 shows a perspective view of a refrigerator with a drainage structure installed therein according to a preferred embodiment of the present invention; FIGS. 3 and 4 show the configuration of main components and a receiving space according to the embodiment shown in FIG. 2, respectively; and FIGS. 5 and 6 show sectional views taken along lines A-A' and B-B', respectively.

As shown in these figures, a freezing chamber door 21 and a refrigerating door 23 are installed side by side on a front surface of a main body 20 of a refrigerator. The doors 21 and 23 are installed such that their free ends can be pivoted on both lateral ends in the front direction of the refrigerator. The doors 21 and 23 selectively open and close freezing and refrigerating chambers, i.e. a storage space provided in the main body 20 of the refrigerator.

A dispenser 25 is provided at a portion on a front surface of the freezing chamber door 21. The dispenser 25 serves to dispense water or ice out of the main body 20 of the refrigerator. An integrated product, i.e. a TV 40 by which a user can watch a TV broadcast, is installed on a front surface of the refrigerating chamber door 23.

To facilitate installing the TV 40, a mounting space 31 is provided at a portion on a front surface of the refrigerating chamber door 23 (hereinafter, referred to as a door). The mounting space 31 is a space defined within a receiving box 30 that is manufactured separately from the door 23. That is, within the receiving box 30 is defined the mounting space 31 which has the depth relatively shorter than the height and width thereof and of which front face is opened. The receiving box 30 is installed in a portion where a front surface of the door 23 is depressed.

A plurality of recesses 32 are formed on an inner surface 31*i* of the mounting space 31 in a direction perpendicular to the gravitational direction, i.e. in a horizontal direction as viewed from the front of the door 23. The recesses 32 serve to prevent water drops formed on the inner surface 31*i* from flowing downward along the inner surface. That is, the water drops flowing downward along the inner surface 31*i* cannot further flow downward because they are caught in the recesses 32. In addition, the water drops caught in the recess 32 are spread from side to side along one surface of the recess 32.

Each of the recesses 32 is formed such that its inner surface 31*i* is depressed. As shown in FIG. 4, the recess 32 with a predetermined vertical width is depressed in the inner surface 31*i* to extend in a horizontal direction. The plurality of recesses 32 are arranged in a vertical direction at a predetermined interval.

As shown in FIG. 5, the vertical width X of a recess 32 and the interval Y between the recess 32 and another recess formed right below or above the recess are about 10 mm. Further, the depth Z of the recess 32 is about 0.5. However, the size of the recess 32 can be determined as a proper value depending on the overall size and shape of the mounting space 31.

In addition, a plurality of valleys 33 are formed on the inner surface 31*i* on which the plurality of recesses 32 are formed. Each of the valleys 33 takes the shape of an irregular line and formed to have a remarkably smaller size as compared with the vertical width and depth of the recess 32.

The valley 33 serves to increase the sectional area of the inner surface 31*i*. The size of water drops is relatively decreased since the water drops permeate into the valley 33 with fine width and depth due to a capillary phenomenon. In other words, the adhesive force of water to the inner surface 31*i* of the receiving box 30 becomes greater than the cohesive force of water itself. For reference, the inner surface 31*i* of the receiving box 30 may be made of a material of which adhesive characteristics are superior.

A wire outlet 34 is formed near the center of a floor surface 31*b* of the mounting space 31. The wire outlet 34 is to take the lead wire (not shown) out from the refrigerator. The lead wire serves to supply external power and a variety of electrical signals. In addition, the lead wire is taken out through the wire outlet 34 and then connected to the TV 40.

The floor surface 31*b* of the mounting space 31 is formed to be inclined downward at a predetermined angle with respect to the horizontal surface. That is, a front end of the floor surface 31*b* is positioned lower than a rear end thereof. The reason is that the water drops, which are neither caught in the recesses 32 nor permeate into the valleys 34 but flow downward, cannot be prevented from staying on the floor surface 31*b* and then being introduced into the wire outlet 34.

Further, a covering duct 35 is provided on the floor surface 31*b* adjacent to the wire outlet 34. The covering duct 35 serves to prevent water drops from being introduced into the wire outlet 34. The covering duct 35 is shaped as a hexahedron of which front face is open.

As shown in FIG. 6, wire guide slits 35' are provided at front ends of both lateral walls of the covering duct 35, respectively. Each of the wire guide slits 35' is formed by cutting out a portion of the lateral wall of the covering duct 35. The lead wire that is taken out through the wire outlet 34 is supported on the wire guide slit 35'.

Furthermore, a pair of fastening holes 36 are formed in an upper end of the receiving box 30. Catching protrusions 37 and supporting hooks 38 are provided at the front end of the floor surface 31*b* of the mounting space 31. A pair of supporting hooks 38 are provided at one of the catching protrusions 37. The fastening holes 36, the catching protrusions 37 and the supporting hooks 38 are to fix a mounting bracket 46 to be explained later to the receiving box 30.

Each of the catching protrusions 37 is formed to protrude upward from the front end of the floor surface 31*b* of the mounting space 31. Each pair of supporting hooks 38 are formed to be spaced apart from each other at a predetermined distance. Each of the supporting hooks 38 protrudes upward from a position spaced apart from the catching protrusion 37, and a leading end of the supporting hook extends again forward.

Further, the supporting hook 38 is spaced apart from the inner surface of the mounting space 31 at a predetermined distance. The reason is that heat generated upon the operation of the TV 40 is prevented from being transferred through the door 23 provided with the mounting space 31 and a space needed for cooling the TV and evaporating water drops formed in the mounting space 31 is obtained.

In addition, a plurality of insertion holes 39 are formed in upper and lower, and right and left edges of the receiving box 30. Fastening hooks (not shown) of a covering frame 49 to be explained later are inserted into the insertion holes 39 such that the covering frame 49 can be fixed to the receiving box 30.

A front panel 41 of the TV 40 is provided with a front opening 42 and a plurality of through-holes 43. A screen 45 is exposed to the outside through the front opening 42. The plurality of through-holes 43 cause the mounting space 31 to communicate with the outside and are perforated through an upper, right and left sides of the front panel 41.

The mounting bracket 46 is fixed to a rear surface of the TV 40. The mounting bracket 46 serves to mount the TV 40 to the mounting space 31 and extends outward from the upper and lower, and right and left edges of the TV 40. The mounting bracket 46 is formed with fastening holes 47, which correspond to the fastening holes 36 of the mounting space 31, at an upper end thereof. Further, screws S are fastened into the fastening holes 36 of the mounting space 31 through the fastening holes 47 of the mounting bracket 46.

A lower end of the mounting bracket 46 is supported by the catching protrusions 37 and the pairs of the supporting hooks 38. That is, a front surface of the lower end of the mounting bracket 46 is brought into close contact with front surfaces of the supporting hooks 38.

In addition, the mounting bracket 46 is formed with through-holes 48 at upper and lower, and right and left edges thereof. The through-holes 48 are formed at positions corresponding to the insertion holes 39 of the receiving box 30. Further, the fastening hooks of the covering frame 49 are inserted into the insertion holes 39 through the through-holes 48.

The covering frame 49 is attached forward to the edges of the receiving box 30 to cover the mounting bracket 46 therewith. The covering frame 49 is also formed with an opening 49' which in turn is sized such that the screen 45 and front panel 41 can be substantially exposed to the outside.

The plurality of fastening hooks (not shown) are provided on upper and lower, and right and left portions of the covering frame 49. The fastening hooks serve to fix the covering frame 49 to the receiving box 30. The fastening hooks are inserted into and fixed to the insertion holes 39 of the receiving box 30 through the through-holes 49 of the mounting bracket 46.

Hereinafter, the operation of the preferred embodiments of the present invention will be described.

First, a process of mounting the TV 40 to the mounting space 31 will be explained.

A portion of the refrigerator door 23 is depressed into the door, and the receiving box 30 is installed within such a depressed portion. Then, as a foaming agent filled in the door 23 is solidified, the volume of the door 23 is increased. Thus, since the depressed portion of the door 23 in which the receiving box 30 is installed is relatively shrunk, the receiving box 30 can be fixed to the front surface of the door 23.

Then, the TV 40 with the mounting bracket 46 fixed to a rear surface thereof is mounted into the mounting space 31 of the receiving box 30. At this time, both sides of the lower end of the mounting bracket 46 are fixed to the receiving box 30 by means of the catching protrusions 37 and the supporting hooks 38. Further, the screws S are fastened into the fastening holes 36 of the mounting space 31 through the fastening holes 47 pf the mounting bracket 46.

In such a state, the fastening hooks of the covering frame 49 are inserted into the insertion holes 39 of the receiving box 30. Thus, the outer edges of the receiving box 30 and the mounting bracket 46 corresponding to the outer edges of the TV 40 are covered with the covering frame 49. The lead wire to be connected to the TV 40 is taken out through the wire outlet 34 formed on the floor surface 31*b* of the mounting space 31. The lead wire is supported on the wire guide slits 35' of the covering duct 35. Thus, a phenomenon that downward sagging of the lead wire due to its own weight causes the lead wire to be damaged or disconnected from the TV 40 can be prevented.

Next, the operation of the TV 40 will be explained.

The TV 40 receives video and audio signals over the radio and reproduces the television broadcast. When the TV 40 is operated in such a manner, heat is generated from a variety of electrical components of the TV 40.

Therefore, the temperature in the mounting space 31 in which the TV is mounted is increased and becomes a temperature relatively higher than a room temperature. On the other hand, the storage space in the refrigerator is maintained to a low temperature state for the purpose of food storage. Thus, moisture may be produced due to the temperature difference between the mounting space 31 and the storage space. Further, the moisture is formed into a water drop on the inner surface 31*i* of the mounting space 31, and the formed water drop flows downward along the inner surface 31*i* due to its own weight.

However, the plurality of recesses 32 are formed on the inner surface 31*i*. Thus, the water drops flowing downward along the inner surface 31*i* in the gravitational direction are caught in the recesses 32. That is, the water drops cannot further flow downward because the drops are caught in the recesses 32, and thus, the water drops caught in the recesses 32 are spread from side to side along the recesses 32.

Furthermore, the plurality of valleys 33 are formed on the inner surface 31*i*. Thus, the water drops flowing downward along the inner surface 31*i* or caught in the recesses 32 permeate into the valleys 33 due to the capillary phenomenon. Therefore, since the size of the water drops is decreased, a phenomenon that the water drops flow downward due to their own weights can be further reduced.

As described above, a predetermined amount of heat is generated when the TV 40 is operated. Thus, since the water drops that have partially permeated into the valleys 33 are decreased in size and uniformly spread over the inner surface 31*i*, the water drops can be evaporated due to the heat generated from the TV 40. Since the water drops are not formed into larger ones in the mounting space 31 but spread over the inner surface 31*i*, the water drops can be more effectively evaporated.

As the water drops are evaporated, air in the mounting space 31 contains moisture. Further, the air in the mounting space 31 is discharged to the outside through the plurality of through-holes 43 formed on the front surface of the TV 40. That is, the moisture formed in the mounting space 31 is in the form of vapor, and thus, it is also discharged to the outside together with the air in the mounting space 31.

Water drops that were not caught in or permeated into the recesses 32 or valleys 33 flow downward along the inner surface 31*i* of the mounting space 31 due to their own weights. However, since the floor surface 31*b* of the mounting space 31 is inclined downward toward the front direction of the refrigerator, the water drops flowing downward along the inner surface 31*i* are discharged to the outside of the mounting space 31 through the floor surface 31*b*.

At this time, the wire outlet 34 formed on the floor surface 31*b* is in a state where its upper and lateral walls are covered with the covering duct 35. As described above, therefore, the water drops discharged through the floor surface 31*b* cannot be introduced into the wire outlet 34 by means of the covering duct 35.

In addition, since the wire guide slits 35' where the wire is caught and supported are formed on the lateral walls of the covering duct 35, the wire cannot be brought into contact with the floor surface 31*b*. Thus, the wire can be prevented from coming into contact with the water flowing the floor surface 31*b*.

Figure 7:
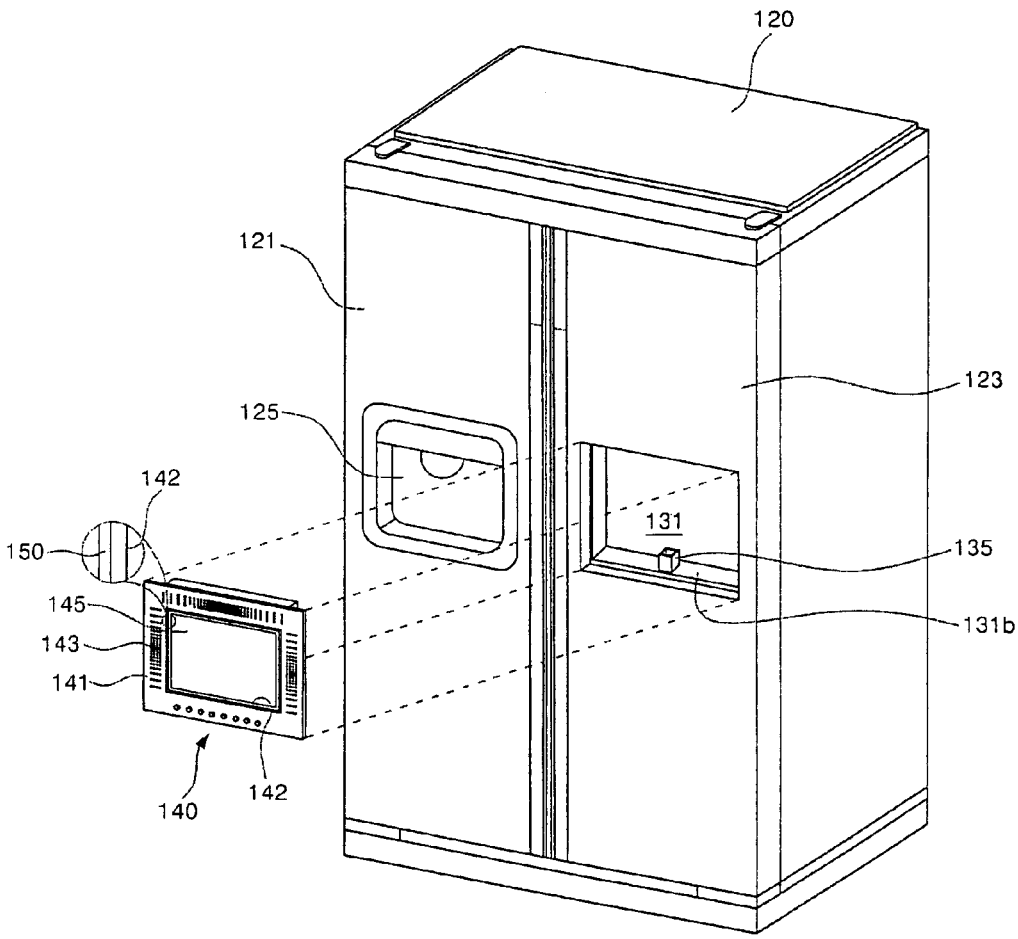
FIG. 7 is an exploded perspective view showing the configuration a refrigerator with a drainage structure formed therein according to another embodiment of the present invention.

Next, another embodiment of the present invention will be explained with reference to FIG. 7. FIG. 7 is an exploded perspective view illustrating the configuration of this embodiment of the present invention.

As shown in this figure, a storage space such as freezing and refrigerating chambers is provided in a main body 120 of the refrigerator, and the freezing and refrigerating chambers are selectively opened and closed by a freezing chamber door 121 and a refrigerating chamber door 123, respectively. A dispenser 125 for taking water out from the outside is provided at a portion on a front surface of the refrigerating chamber door 121.

A predetermined mounting space 131 is provided on a front surface of the refrigerating chamber door 123 (hereinafter, referred to as a door). The mounting space 131 is used for mounting a TV 140 to be explained later, and shaped as a generally flat hexahedron of which depth is relatively shorter than the height and width thereof. The mounting space 131 may be formed by installing an additional receiving box on the door 123 as illustrated in the embodiment described above. Alternatively, the mounting space 131 may be integrally formed on the door 123.

An inclined portion 131*b* is provided on a floor surface of the mounting space 131. The inclined portion 131*b* is formed to be inclined downward toward the front of the refrigerator and is used to allow water drops, which are generated in the mounting space 131 or transferred from the outside into the mounting space 131, to be discharged to the outside.

A lead wire (not shown) for supplying the TV 140 with electrical signals is taken out through an outlet (not shown) formed at the center of the inclined portion 131*b*. A covering duct 135 is provided on the inclined portion 131*b* to cover the outlet therewith. The covering duct 135 is to prevent water drops from permeating into the outlet and protrudes upward from the inclined portion 131*b* by a predetermined height.

A rectangular opening 142 is formed at the center of a front panel 141 of the TV 140 mounted into the mounting space 131, and a screen 145 of the TV 140 is exposed to the outside through the opening 142. A plurality of through-holes 143 serving as both cooling holes and speaker holes are perforated on portions of the front panel 141 which correspond to upper, right and left peripheries of the opening 142.

Further, a drainage channel 150 is formed in the front panel 141. The drainage channel 150 serves to prevent water drops flowing along the front panel 141 from being introduced into the TV 140 via a gap between the opening 142 and the screen 145 or the through-holes 143.

In the illustrated embodiment, the drainage channel 150 is formed around an inner edge of the front panel 141. That is, the drainage channel 150 is formed on the front panel 141 to circumscribe the opening 142. Alternatively, the drainage channel 150 may be formed to circumscribe an outer edge of the front panel 141. Of course, the drainage channel may also be formed to circumscribe the inner and outer edges of the front panel 141.

Furthermore, a predetermined insertion hole is formed on a bottom surface of the TV 140. The insertion hole is preferably formed on a position corresponding to the covering duct 135 such that the covering duct 140 and the bottom surface of the TV 140 cannot interfere with each other, whereby the TV 140 is not prevented from being mounted into the mounting space 131.

For reference, although a structure required for mounting the TV 140 into the mounting space 131 has not been illustrated in this embodiment, it maybe a structure shown in FIG. 2 may be employed instead. In addition, the covering frame 49 may be used as an external frame to which the TV 140 is mounted.

Now, the operation of this embodiment of the present invention described above will be explained in detail.

Since the refrigerator is generally installed at a kitchen where water is frequently used, water drops may be splashed on the front panel 141 of the TV 140 while a user does the housework or cleans the refrigerator. The water drops, which are splashed on the front panel 141 of the TV 140, flow downward due to their own weights and move downward along the drainage channel 150 formed on the front panel 141. Thus, this can prevent the water drops from permeating into the TV 140 through the gap between the opening 145 and the screen 145 or the through-holes 143.

Furthermore, water drops may permeate into the mounting space 131 through a gap between the mounting space 131 and the TV 140, or moisture contained in air within the mounting space 131 may be condensed due to heat generated by the operation of the TV 140. The water drops remaining in the mounting space 131 is discharged to the outside while being guided along the inclined portion 131*b* on the floor surface of the mounting space 131.

As described above, the outlet through which the lead wire is taken out is formed at a position on the inclined portion 131*b*, but the covering duct 135 is provided to cover the outlet therewith. Therefore, the covering duct 135 can prevent the water drops guided along the inclined portion 131*b* from permeating into the outlet.

The drainage structure for a refrigerator equipped with an integrated product according to the present invention described above in detail has the following advantages.

First, moisture remaining in the mounting space into which the integrated product is mounted is evaporated and discharged to the outside due to heat generated from the integrated product when it is operated. Therefore, damage or malfunction of the integrated product due to the moisture can be beforehand prevented.

Further, the refrigerator is generally used in a wet kitchen. However, even though water drops are splashed on the exterior of the integrated product, the drainage structure of the present invention can prevent the splashed water drops from permeating into the integrated product. Therefore, the damage or malfunction of the integrated product can be prevented.

It will be apparent to those skilled in the art that other various modifications and changes can be made within the scope of the fundamental technical spirit of the present invention. Therefore, the scope of the present invention should be construed on the basis of the appended claims.

What is claimed is:

1. A drainage structure for a refrigerator with an integrated product mounted on a door thereof, the structure comprising:

a mounting space provided at a front surface of the refrigerator door, wherein the mounting space comprises a rear surface and four side surfaces extending therefrom which define a periphery of the mounting space, wherein a front of the mounting space is open so as to receive an integrated product therein; and a plurality of recesses formed in the rear surface of the mounting space and extending in a direction perpendicular to a gravitational direction.

2. The structure as claimed in claim 1, wherein each of the recesses has a predetermined width and depth, and is formed in a straight line such that adjacent recesses are spaced apart from each other at a predetermined interval in the gravitational direction.

3. The structure as claimed in claim 2, further comprising a plurality of valleys formed in the rear surface of the mounting space in the form of irregular lines.

4. The structure as claimed in claim 3, wherein a lower surface of the four side surfaces of the mounting space comprises a floor surface inclined downward toward a front of the door at a predetermined angle with respect to a horizontal surface.

5. The structure as claimed in claim 4, further comprising a covering duct formed on the floor surface of the mounting space, wherein the covering duct covers a wire outlet through which a lead wire to be connected to the integrated product extends.

6. The structure as claimed in claim 5, wherein the covering duct has a substantially hexahedral shape with a front face that opens toward the front of the door.

7. The structure as claimed in claim 6, further comprising a wire guide slit formed on at least one of the lateral side walls of the covering duct so as to hold the lead wire extending therethrough.

8. The structure as claimed in claim 1, further comprising a drainage channel formed along an inner edge of a front panel coupled to the integrated product, wherein the drainage channel is configured to guide water drops along its surface.

9. A drainage structure for a refrigerator having a door, the structure comprising:

a receiving box having a mounting space formed therein, wherein the receiving box is configured to be mounted on a front surface of the door such that the mounting space is open toward a front of the door, wherein the mounting space is configured to receive an integrated product secured therein;

a plurality of recesses formed in a rear surface of the mounting space extending in a direction perpendicular to a gravitational direction; and a floor surface which extends at a downward incline from a lower edge of the rear surface of the mounting space toward a front of the mounting space.

10. The structure as claimed in claim 9, wherein a mounting bracket is provided at a rear of the integrated product so as to be fastened to an edge of the receiving box, a front panel is provided at a front surface of the integrated product so as to define an edge of the integrated product, and a covering frame is mounted to the edge of the front surface of the integrated product so as to cover the edge of the front panel and the edge of the receiving box.

11. The structure as claimed in claim 10, wherein each of the recesses has a predetermined width and depth, and is formed in a straight line such that adjacent recesses are spaced apart from each other at a predetermined interval in the gravitational direction.

12. The structure as claimed in claim 9, further comprising a plurality of valleys formed in the rear surface of the mounting space in the form of lines.

13. The structure as claimed in claim 10, further comprising a covering duct formed on the floor surface of the mounting space so as to cover a wire outlet through which a lead wire to be connected to the integrated product extends.

14. The structure as claimed in claim 10, wherein the covering duct has a generally hexahedral shape, with a front face that is open toward the front of the door.

15. The structure as claimed in claim 14, further comprising a wire guide slit formed on at least one of the lateral walls of the covering duct so as to hold the lead wire extending therethrough.

16. The structure as claimed in claim 10, further comprising a drainage channel extending along an edge of the front panel so as to guide water drops along its surface and away from the integrated product coupled thereto.

17. A drainage structure for a refrigerator in which a storage space defined in a main body of the refrigerator is opened and closed by a door, the structure comprising:

a receiving box having a mounting space formed therein, wherein the receiving box is mounted on a front surface of the door such that the mounting space is open toward the front of the door, wherein the mounting space is configured to receive an integrated product secured therein;

a plurality of recesses formed in a rear surface of the mounting space and extending in a direction perpendicular to a gravitational direction; and a plurality of valleys formed in the rear surface of the mounting space in the form of lines.

18. The structure as claimed in claim 17, further comprising a floor surface formed on a lower end of the mounting space and inclined downward toward a front of the mounting space, and a covering duct formed on the floor surface of the mounting space so as to cover a wire outlet through which a lead wire to be connected to the integrated product extends.

19. The structure as claimed in claim 18, wherein the covering duct has a generally hexahedral shape, with a front face that is open toward the front of the door, and wherein a wire guide slit is formed on at lest one of the lateral walls of the covering duct so as to hold the lead wire extending therethrough.

20. The structure as claimed in claim 18, wherein a mounting bracket is provided at a rear of the integrated product so as to be fastened to an edge of the receiving box, a front panel is provided at a front surface of the integrated product so as to define an edge of the integrated product, and a covering frame is mounted on the front surface of the integrated product so as to cover the edge of the front panel and the edge of the receiving box.

21. The structure as claimed in claim 17, wherein each of the recesses has a predetermined width and depth, and is formed in a straight line such that adjacent recesses are spaced apart from each other at a predetermined interval in the gravitational direction.

22. The structure as claimed in claim 20, further comprising a drainage channel along which water drops are guided circumscribing the edge of the front panel of the integrated product.

* * * * *